US005876075A

United States Patent [19]

Barthelmess, Jr.

[11] Patent Number: 5,876,075

[45] Date of Patent: Mar. 2, 1999

[54] PORTABLE WIRE GATE CLOSER

[76] Inventor: Leo Floyd Barthelmess, Jr., HC 84 Box 8058, Malta, Mont. 59538

[21] Appl. No.: 519,299

[22] Filed: Aug. 25, 1995

[51] Int. Cl.[6] ..... E05C 5/00

[52] U.S. Cl. ..... 292/247; 292/246

[58] Field of Search ..... 292/247, 246, 292/113, 104, 105, DIG. 49, DIG. 13

[56] References Cited

U.S. PATENT DOCUMENTS

| | | | |
|---|---|---|---|
| 398,714 | 2/1889 | Farr | 24/116 R |
| 753,175 | 2/1904 | Stange | 292/247 |
| 754,357 | 3/1904 | Spencer | 292/247 |
| 762,481 | 6/1904 | Klipping | 39/74 |
| 912,333 | 2/1909 | Tschirley | 292/247 |
| 1,036,040 | 8/1912 | Wadleigh | 292/247 |
| 1,190,587 | 7/1916 | Roda | 292/247 |
| 1,234,286 | 7/1917 | Chambers | 292/247 |
| 1,264,120 | 4/1918 | Neiss | 292/247 |
| 1,391,578 | 9/1921 | Powell | 292/247 |
| 1,397,459 | 11/1921 | Schmele | 292/247 |
| 1,549,321 | 8/1925 | MacFarland | 292/247 |
| 1,570,734 | 1/1926 | Eversman | 292/247 |
| 2,770,482 | 11/1956 | Kusiek | 292/246 |
| 2,773,714 | 12/1956 | McKinney | 292/246 |
| 3,450,187 | 6/1969 | Foltz | 292/247 |
| 3,473,598 | 10/1969 | Winter et al. | 292/246 |
| 3,893,724 | 7/1975 | Reinfeld | 292/247 |
| 5,028,183 | 7/1991 | Huddle et al. | 410/101 |
| 5,098,140 | 3/1992 | Kentner | 292/247 |
| 5,465,595 | 11/1995 | Sheppard | 70/416 |

FOREIGN PATENT DOCUMENTS

| | | | |
|---|---|---|---|
| 282609 | 12/1927 | United Kingdom | 292/246 |

*Primary Examiner*—Steven N. Meyers
*Assistant Examiner*—Gary Estremsky
*Attorney, Agent, or Firm*—Risto A. Rinne, Jr.

[57] ABSTRACT

A portable apparatus for closing wire gates includes an inner U-shaped ring that is pivotally attached at each end of the inner U-shaped ring to a U-shaped handle at each of two open ends thereof. A first length of chain is attached near to one of the two open ends of the U-shaped handle. A second length of chain is attached near to the remaining end of the two open ends of the U-shaped handle. The second length of chain includes a hook that can be attached to any link of the first length of chain, and therefore provides a method to adjust the overall combined length of the first length of chain and the second length of chain as desired. The inner U-shaped ring bears against a first post that is to be drawn closer toward a second post thereby eliminating the need for any attachment of the closer to either the first post or to the second post. The first length of chain is placed around the second post and the second length of chain is extended and the hook thereof is attached to a desired link of the first length of chain. The U-shaped handle is lowered into a horizontal attitude which draws the first post closer toward the second post. A second hook attached to a center of the U-shaped handle is placed around a section of wire as desired to better secure the gate closer in the closed position.

2 Claims, 2 Drawing Sheets

PORTABLE WIRE GATE CLOSER

BACKGROUND OF THE INVENTION

1. Field of the Invention

The present invention, in general, relates to gate latches and, more particularly, to wire gate closers.

Wire gate closers are well known devices that attach to a fixed post and then pull an intermediate wire gate toward the fixed post and secure it in position.

Known types of wire gate closers are adjusted to fit the particular wire gate they are to be used in conjunction with. They are not portable devices and, as such, must be attached to the post. After attachment, either the wire gate itself is adjusted to fit the closer, or the closer is adjusted within a limited range to accommodate the particular wire gate.

However, in use farmers, ranchers, and the like often need to close a particular wire gate only when livestock is contained in a particular area. When the livestock is required to graze in a second area, then the first particular area need not have its gate closed wherein the second area will now require the use of a gate closer.

Known types of closers because they are attached to at least one post are not portable.

Accordingly there exists today a need for a portable wire gate closer that can accommodate a wide range of adjustment to satisfy the requirements of many wire gates.

2. Description of Prior Art

Gate closers are, in general, known. For example, the following patents describe various types of these devices:

U.S. Pat. No. 1,261,365 to Cummings, Apr. 2, 1918;

U.S. Pat. No. 1,264,120 to Neiss, Apr. 23, 1918;

U.S. Pat. No. 1,391,578 to Powell, Sep. 20, 1921;

U.S. Pat. No. 1,482,164 to Sutton, Jan. 29, 1924;

U.S. Pat. No. 1,692,726 to Estabrooks, Nov. 20, 1928;

U.S. Pat. No. 2,704,900 to Olson, Mar. 29, 1955;

U.S. Pat. No. 2,747,910 to Salmon, May 29, 1956;

U.S. Pat. No. 3,893,724 to Reinfeld, Jul. 8, 1975;

U.S. Pat. No. 4,307,906 to Schenk, Dec. 29, 1981;

U.S. Pat. No. 4,683,934 to Salsness, Aug. 4, 1987;

U.S. Pat. No. 4,940,265 to Weigel, Jul. 10, 1990; and

U.S. Pat. No. 5,098,140 to Kenter, Mar. 24, 1992.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an important object of the present invention to provide a portable wire gate closer that is readily adaptable for transport to different locations.

It is also an object of the invention to provide a portable wire gate closer that is adjustable to accommodate a variety of wire gates.

Another object of the invention is to provide a portable wire gate closer that is easy to manufacture.

Still another object of the invention is to provide a portable wire gate closer that is easy to use.

Yet another object of the invention is to provide a portable wire gate closer that does not require attachment to a post.

Briefly, a portable wire gate closer that is constructed in accordance with the principles of the present invention has an inner U-shaped ring that is pivotally attached at each end of the inner U-shaped ring to a U-shaped handle at each of two open ends thereof. A first length of chain is attached near to one of the two open ends of the U-shaped handle. A second length of chain is attached near to the remaining one of the two open ends of the U-shaped handle. The second length of chain includes a hook that can be attached to any link of the first length of chain, and therefore provides a method to adjust the overall combined length of the first length of chain and the second length of chain as desired. The inner U-shaped ring bears against a first post that is to be drawn closer toward a second post. A second hook is attached to a center of the U-shaped handle and is placed around a section of wire if desired to better secure the gate closer in the closed position.

DETAILED DESCRIPTION OF THE INVENTION

Figure 1:
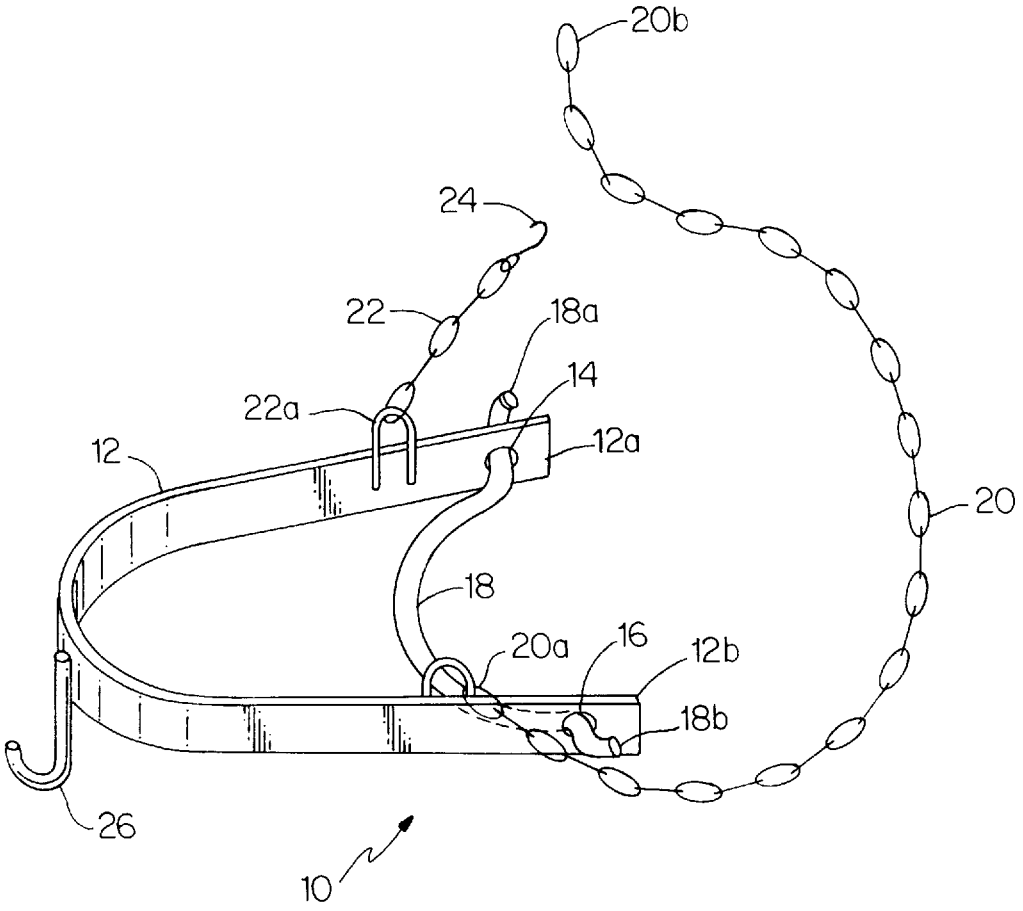
FIG. 1 is a view in perspective of a portable wire gate closer.
Figure 2:
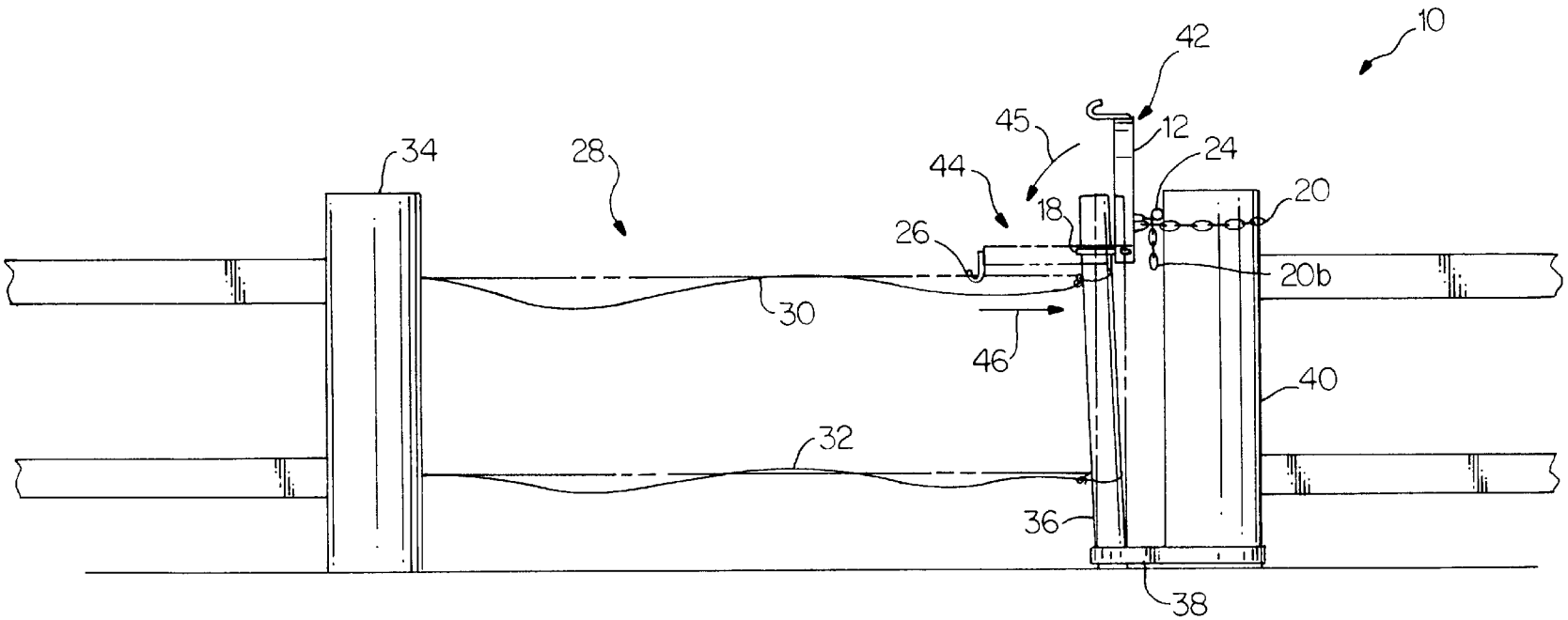
FIG. 2 is a is a view in perspective of a portable wire gate closer being used to draw a first fence post closer toward a second fence post shown in the open (loose) position and partially shown in dashed lines in the closed (tight) position.

Referring to FIG. 1 and on occasion to FIG. 2 is shown, a portable wire gate closer, identified in general by the reference numeral 10.

A generally U-shaped handle 12 includes a first end 12*a* and a second end 12*b*. For the described embodiment the material used for construction of the various component parts of the closer 10 is mild steel as it is an easy material to work and component parts thereof can be readily fastened by welding, bolting, etc., as desired. However the use of other materials is anticipated including other metals, plastics, and composite materials as are preferred.

Accordingly the U-shaped handle 12 is preferably made of a strap of mild steel that is bent into the desired U-shape. A first hole 14 is bored through the U-shaped handle 12 near to the first end 12*a* and a second hole 16 is bored near to the second end 12*b* thereof.

An inner U-shaped ring 18 is pivotally disposed inside the U-shaped handle wherein a first ring end 18*a* of the U-shaped ring 18 passes through the first hole 14 and a second ring end 18*b* of the U-shaped ring 18 passes through the second hole 16.

Both the first ring end 18*a* and the second ring end 18*b* are bent as shown after insertion through the first hole 14 and the second hole 16 so as to maintain the U-shaped ring 18 in a position of cooperation with the U-shaped handle 12. The first hole 14 and the second hole 16 together define an axis about which the U-shaped ring 18 is able to pivot with respect to the U-shaped handle 12. The U-shaped ring 18 is preferably constructed of round stock.

A first chain 20 is attached at a first chain end 20*a* by welding or by bolting it to the U-shaped handle 12 a predetermined distance away from the second end 12*b* thereof.

The greater the distance that the first chain 20 is attached that is away from the second end 12*b* the greater will be the amount of closure of the gate that occurs, as is described in greater detail hereinbelow, but the lesser will be the leverage to accomplish the closure.

Therefore the predetermined distance away from the second end 12*b* at which the first chain 20 is attached is selected either to satisfy particular circumstances or it is selected to provide an overall compromise between the leverage that is supplied by the closer 10 and the amount of closure that occurs.

A second chain end 20*b* is shown open in FIG. 1 and is used to provide a variable length of closer 10 adapted for use with different fence posts as described in greater detail hereinbelow.

A second chain 22 is similarly attached at a first second chain end 22*a* to the U-shaped handle 12 a predetermined distance away from the first end 12*a* thereof. A hook 24 is attached to the remaining end of the second chain 22.

A second hook 26 is attached to the U-shaped handle 12 at a location intermediate the first end 12*a* and the second end 12*b* thereof and is used to secure the closer 10 in the closed position as is described in greater detail hereinbelow.

Operation

Referring now primarily to FIG. 2, the closer 10 is being used to secure a wire gate, identified in general by the reference numeral 28. The wire gate 28 includes a plurality of strands of wire 30, 32 that are attached at a first wire end of each to a fixed fence post 34 and are attached at a second wire end of each to a portable fence post 36.

The bottom of the portable fence post 36 is inserted into a retainer 38 that is in turn attached to a second fixed fence post 40. The retainer 38 usually is constructed out of a strap of steel that is fastened at each end thereof to the second fixed fence post 40 although it may be formed of a loop of wire (not shown).

The purpose of the retainer 38 is to secure the bottom of the portable fence post 36 at a predetermined distance away from the second fixed fence post 40.

Tension produced by the plurality of strands of wire 30, 32 apply a resistance to the top of the portable fence post 36 which tends to keep it away from the second fixed fence post 40. The closer 10 is placed so that the U-shaped ring 18 is placed adjacent to the portable fence post 36 near the top thereof.

The first chain 20 is then tightly draped around the top of the second fixed fence post 40. The hook 24 of the second chain 22 is then inserted into whatever link of the first chain 20 provides a tight fit of the first chain 20 around the second fixed fence post 40 when the U-shaped handle is disposed in a first position having a vertical orientation as shown in solid lines and identified by the reference numeral 42.

The second chain end 20*b* and the remainder (excess) of the first chain 20 is allowed to extend away from the hook 24 and to hang freely. Depending upon the particular dimensions of each installation, the remainder of the first chain 20 will vary from a great excess to no excess at all, in which case the hook 24 will pass through a link which is the second chain end 20*b*.

Accordingly the U-shaped handle 12 is then urged by the user (not shown) from the first position 42 (vertical orientation) into a second position having a horizontal orientation as shown in dashed lines and identified by the reference numeral 44. A first arrow 45 shows the general direction of motion by the U-shaped handle 12.

The U-shaped ring 18 continues to bear against the portable fence post 36 and to pivot with respect to the U-shaped handle 12 as the U-shaped handle 12 is urged into the second position 44.

The first chain end 20*a* and the first second chain end 22*a* pivot about the axis that is defined by the first hole 14 and the second hole 16 when the U-shaped handle 12 is urged into the second position 44 thereby displacing the first chain end 20*a* and the first second chain end 22*a* to a position that is disposed further away from the second fixed fence post 40 in the horizontal orientation (second position 44) than in the vertical orientation (first position 42) of the U-shaped handle 12.

This draws the top of the portable fence post 36 closer to the top of the second fixed fence post 40 when the U-shaped handle 12 is in the second position 44 which in turn tightens the plurality of strands of wire 30, 32 as is shown by a second arrow 46.

The U-shaped ring 18, as it continues to bear against the portable fence post 36 and to pivot with respect to the U-shaped handle 12 provides a method of applying a force to urge the tops of both the second fixed fence post 40 and the portable fence post 36 closer to each other without having to attach the closer 10 to either the portable fence post 36 or to the second fixed fence post 40.

The first chain 20 and the second chain 22 in cooperation with the U-shaped ring 18 provide a flexible method to adjust the size of the closer 10 to fit different wire gates (not shown). Accordingly a wire gate closer 10 that can readily be used to close the wire gate 28 and which is portable is described.

In the second position 44 the second hook 26 is placed around one of the plurality of strands of wire 30 to secure the U-shaped handle in the second position 44 and therefore to secure the closer 10 in the closed position. The second hook 26 is not required to be placed around one of the plurality of strands of wire 30 as the closer 10 tends to stay in the second (closed) position 44 normally.

The invention has been shown, described and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A portable wire gate closer, comprising:

(a) an outer U-shaped handle having a first end and a second end and including a first aperture through said U-shaped handle disposed proximate said first end and a second aperture through said U-shaped handle disposed proximate said second end, said first aperture and said second aperture defining an axis;

(b) an inner U-shaped member having a first member end and a second member end, said first member end including first means for pivoting about said axis, and said second member end including second means for pivoting about said axis, said inner U-shaped member being pivotable about said axis with respect to said U-shaped handle;

(c) a first chain having a first end attached to said U-shaped handle;

(d) a second chain having a first end attached to said U-shaped handle; and (e) means for detachably attaching said second chain to said first chain at a plurality of locations along the length of said first chain thereby providing means for varying the combined length of said first chain and said second chain.

2. A portable wire gate closer, comprising:

(a) an outer U-shaped handle having a first end and a second end and including a first hole through said U-shaped handle disposed proximate said first end and a second hole through said U-shaped handle disposed proximate said second end, said first hole and said second hole defining an axis;

(b) an inner U-shaped member having a first member end and a second member end, said first and second ends passing through said first and second holes, respectively of said U-shaped handle, said inner U-shaped member being pivotable about said axis with respect to said U-shaped handle;

(c) a first chain having a first end attached to said U-shaped handle;

(d) a second chain having a first end attached to said U-shaped handle; and (e) means for detachably attaching said second chain to said first chain at a plurality of locations along the length of said first chain thereby providing means for varying the combined length of said first chain and said second chain.

* * * * *